US010933411B2

(12) United States Patent
Dudek et al.

(10) Patent No.: US 10,933,411 B2
(45) Date of Patent: Mar. 2, 2021

(54) PIPETTING SYSTEM TIP HAVING DOUBLE CONICITY

(71) Applicant: GILSON SAS, Villiers-le-Bel (FR)

(72) Inventors: Bruno Dudek, Orry la Ville (FR); Jonathan Barbieux, Noisiel (FR)

(73) Assignee: GILSON SAS, Villiers-le-Bel (FR)

( * ) Notice: Subject to any disclaimer, the term of this patent is extended or adjusted under 35 U.S.C. 154(b) by 188 days.

(21) Appl. No.: 16/310,024

(22) PCT Filed: Jun. 15, 2017

(86) PCT No.: PCT/FR2017/051552
§ 371 (c)(1),
(2) Date: Dec. 14, 2018

(87) PCT Pub. No.: WO2017/216489
PCT Pub. Date: Dec. 21, 2017

(65) Prior Publication Data

US 2019/0329239 A1 Oct. 31, 2019

(30) Foreign Application Priority Data

Jun. 17, 2016 (FR) ..... 16 55652

(51) Int. Cl.
*B01L 3/02* (2006.01)

(52) U.S. Cl.
CPC ..... *B01L 3/0286* (2013.01); *B01L 3/0275* (2013.01); *B01L 2200/023* (2013.01); *B01L 2200/0689* (2013.01); *B01L 2200/087* (2013.01)

(58) Field of Classification Search
CPC ..... B01L 2200/087; B01L 2300/023; B01L 2300/025; B01L 3/021; B01L 3/0217;
(Continued)

(56) References Cited

U.S. PATENT DOCUMENTS

2010/0196210 A1* 8/2010 Jungheim ..... B01L 3/0275 422/526
2011/0174087 A1* 7/2011 Kimura ..... B01L 3/0217 73/864.01

(Continued)

FOREIGN PATENT DOCUMENTS

FR 3026658 A1 * 4/2016 ..... B01L 3/0275
FR 3026658 A1 4/2016

OTHER PUBLICATIONS

International Search Report for International Application Serial No. PCT/FR2017/051552 dated Aug. 17, 2017.

(Continued)

*Primary Examiner* — John Fitzgerald
*Assistant Examiner* — Truong D Phan
(74) *Attorney, Agent, or Firm* — Pearne & Gordon LLP

(57) ABSTRACT

In order to increase the compatibility of a pipetting system tip with various types of cones, the invention provides a tip comprising a first group of first cone retention elements defining a first maximum outer diameter; a second group of second cone retention elements defining a second maximum outer diameter; a third group of third cone retention elements defining a third maximum outer diameter. The first maximum outer diameter and the second maximum outer diameter being different so as to together define a first tip portion having a first conicity, and the second maximum outer diameter and the third maximum outer diameter being different so as to together define a second tip portion having a second conicity smaller than the first conicity.

15 Claims, 8 Drawing Sheets

(58) Field of Classification Search
CPC .... B01L 3/0237; B01L 3/0279; B01L 3/0286; B01L 2400/0478; B01L 3/022; B01L 3/0268; B01L 3/02; B01L 3/0213; B01L 2200/00; B01L 2200/023; B01L 2200/021; B01L 2200/022; B01L 2200/025; B01L 2200/08
See application file for complete search history.

(56) References Cited

U.S. PATENT DOCUMENTS

| | | | | |
|---|---|---|---|---|
| 2017/0028397 | A1 | 2/2017 | Dudek | |
| 2018/0178211 | A1 | 6/2018 | Dudek et al. | |
| 2018/0250667 | A1* | 9/2018 | Dudek ..... | B01L 3/0279 |

OTHER PUBLICATIONS

Preliminary French Search Report for French Patent Application Serial No. 1655652 dated Feb. 6, 2017.

* cited by examiner

PIPETTING SYSTEM TIP HAVING DOUBLE CONICITY

TECHNICAL FIELD

The present invention relates to the field of multichannel pipetting systems such as automated pipetting systems called robots, and single-channel or multichannel sampling pipettes, also called laboratory pipettes, or air displacement liquid transfer pipettes, intended for the calibrated sampling and introduction of liquid into containers. Such pipettes, whether they are manual, motorised or hybrid, are intended to be held by hand by an operator during sampling and liquid dispensing operations.

The invention relates more specifically to the design of the tips of these pipetting systems, the tips being intended to carry the sampling cones forming consumable elements.

PRIOR ART

From the prior art, multichannel sampling pipettes are known, having a design of type integrating a body forming a handle, as well as a lower end having, at the end thereof, several sampling cone-carrying tips, of which the known function is to carry sampling cones, also called consumables.

On conventional pipettes, each tip comprises two annular portions for holding the cone, each forming a protrusion over the outer surface of the tip, and being spaced from one another along an axial direction of the tip. The upper holding portion, in protrusion form, mainly fulfils the function of holding the cone by friction, and limits the introduction in the latter, in the tip. The lower portion, although also contributing to holding the cone, fulfils the sealing function between the sampling cone and the tip. Together, the two holding portions ensure the centring of the tip and of the cone.

This design is the design that has been encountered for decades in pipettes.

However, a new design has recently been proposed, aiming to reinforce the ergonomics of the operation of press-fitting the cones. This design is defined in document FR 3 026 658. It provides a lip seal on the tip to ensure sealing with the sampling cone, as well as two portions for holding the cone arranged on either side of the seal. Because of this, the contact force between the cone and the tip at the level of two holding portions can be weak, since these portions are no longer used to obtain the sealing. The press-fitting force of the cones finds itself advantageously reduced, and slightly impacted by the cooperation between the cone and the lip seal, because of the intrinsic flexibility of the latter. For information purposes, with such a design, an axial press-fitting force of around 5 N through the tip proves to be sufficient for obtaining a sealing and a correct holding of each multichannel pipette cone. For example, sufficient results are obtained with an axial press-fitting force of around 40 N, on a multichannel, eight-tip pipette.

The operation of press-fitting the cones is thus more ergonomic, limiting the risks of musculoskeletal disorders (MSDs) for operators.

Thus, this design has the particularity of separating the tip means dedicated to the mechanical holding of the cone by friction, and those dedicated to obtaining sealing, formed by a lip seal, of which the bending force of the lip(s) is substantially less than the compression force of a conventional O-ring.

In addition, by axially offsetting the two holding portions, these ensure a long centring which moreover ensures a perfect lateral holding of the sampling cone, capable of resisting the radial stresses likely to be encountered during the handling of the pipette, during pipetting operations. Finally, the action of interleaving the seal between these two protruding holding portions, in other words, forming a relief on the outer surface of the tip, provides an optimisation of the axial length of the tip.

In view of the above, it is noted that the solution from document FR 3 026 658 gives a response to the need to reduce the press-fitting force/ejection force, while guaranteeing the sealing and the mechanical strength of the cones, even when the latter are stressed. Such a mechanical stress is produced, for example, during a "licking" movement carried out by the operator, during which the ends of the cones scrape the inner surface of a shaft in order to transfer the last drop of liquid likely to be retained by capillarity at the end of the consumable. In this scenario, it is important to preserve the mechanical strength of each cone, in order, in particular, to make them remain parallel to one another during the scraping on the successive shafts.

It is moreover noted, that to encourage the radial deformation of the collar of the sampling cone without increasing the press-fitting force, the annular holding portions can be made using specific elements spaced from one another, as is also mentioned in document FR 3 026 658. Therefore, a technique is related to, which enables to reinforce the mechanical strength of the cone, without increasing the press-fitting force.

Generally, the solution from document FR 3 026 658 is based on the presence of a seal arranged between two zones for holding/mechanically retaining the sampling cone, which can be applied to a single-channel pipette, even if it has a specific interest for multichannel pipettes.

In any case, there remains a need to optimise pipette tips, aiming to benefit from the advantages mentioned above, while expanding the compatibility of the tip with different types of consumables, in particular with different collar conicities encountered on sampling cones available on the market. In addition, this need exists similarly for robots, also intended to function with consumables of different shapes.

DESCRIPTION OF THE INVENTION

To at least partially meet this need, the invention first aims for a sampling cone-carrying tip for the lower end of a pipetting system, the tip having a longitudinal axis falling into a first fictitious plane.

According to the invention, the tip comprises successively from bottom to top along the longitudinal axis thereof, protruding radially towards the outside from an outer surface of the tip:

- a first group of first elements for retaining the sampling cone spaced from one another along a first annular zone of the tip, two of said first retaining elements being arranged in a second fictitious plane, orthogonal to the first fictitious plane, and defining a larger outer diameter, called first maximum outer diameter;
- a second group of second elements for retaining the sampling cone spaced from one another along a second annular zone of the tip, two of said second retaining elements being arranged in said second fictitious plane and defining a larger outer diameter, called second maximum outer diameter;
- a third group of third elements for retaining the sampling cone spaced from one another along a third annular zone of the tip, two of said third retaining elements being arranged in said second fictitious plane and defining a larger outer diameter, called third maximum outer diameter.

In addition, the tip also carries a gasket arranged between the first and the third annular zone of the tip.

Finally, on the one hand, the first maximum outer diameter as well as the second maximum outer diameter are different so as to together define a first tip portion having a first conicity, and on the other hand, the second maximum outer diameter as well as the third maximum outer diameter are different so as to together define a second tip portion having a second conicity, less than the first conicity.

The invention is noteworthy, in that it enables to define two tip portions which succeed one another axially and which therefore have different conicities, which could be adapted to a great variety of sampling cones. According to the geometry thereof, the cone will therefore be retained by friction by the first and second groups of retaining elements, or by the second and third groups of retaining elements, while cooperating with the seal to ensure sealing. In any case, the double mechanical retaining of the cone, by friction, ensures a satisfactory holding of the latter, in particular during a "licking" movement carried out by the operator.

Thanks to the invention, the range of using such tips is broadly extended, with no compromise on the holding, alignment and sealing of the sampling cones, nor on the intensity of the press-fitting force to be produced during coupling between the tip and the cone.

The invention also aims for a lower end of the pipetting system comprising at least one such sampling cone-carrying tip.

This lower end can be intended for a single-channel pipetting system, and thus comprise one single sampling cone-carrying tip.

Alternatively and preferably, the lower end of the pipette is intended for a multichannel pipetting system, and comprises a plurality of sampling cone-carrying tips having longitudinal axes falling into said first fictitious plane.

The invention has at least one of the following optional characteristics, taken by themselves, or in combination.

The first retaining elements of the first group, except for said two first retaining elements defining the first maximum outer diameter are situated radially towards the inside and remotely from a first fictitious circle defined by said first maximum outer diameter. This non-axisymmetric design enables to deform the collar of a non-circular cone using the two first retaining elements defining the first maximum outer diameter. An even more increased extension of the range of using the tip advantageously arises from this.

In this scenario, it is, for example, made sure that in addition to said two first retaining elements defining the first maximum outer diameter, one or more couples of first retaining elements defining one or more of the first diameters less than the first maximum outer diameter, among which at least one first smaller diameter situated in said first fictitious plane. This enables a substantially elliptic deformation of the collar of a cone, for an increase in the range of using the tip which is thus capable of being adapted to collars of varied conicities.

Similarly, the third retaining elements of the third group, except for said two third retaining elements defining the third maximum outer diameter, are situated radially towards the inside and remotely from a third fictitious circle defined by said third maximum outer diameter. Here also, it is preferably provided, that the third group comprises, in addition to said two third retaining elements defining the third maximum outer diameter, one or more couples of third retaining elements defining one or more third diameters less than the third maximum outer diameter, among which at least one third smaller diameter situated in said first fictitious plane.

Preferably, the second retaining elements of the second group are situated on a second fictitious circle defined by said second maximum outer diameter. However, a non-axisymmetric solution such as that defined above for the first and third groups could be adopted for the second group, without moving away from the scope of the invention.

However, in the axisymmetric solution, it is preferably made such that the second group comprises, in addition to said two second retaining elements defining the second maximum outer diameter, one or more couples of second retaining elements defining one or more other second maximum outer diameters, among which at least one second maximum outer diameter situated in said first fictitious plane.

Preferably, the first conicity is between 3 and 4.5°, and in that the second conicity is between 2 and 3.4°.

Preferably, for a multichannel pipetting system, the number of tips is between 2 and 16, and more preferably still, between 8 and 12.

To limit the press-fitting force, the gasket is preferably a lip seal. However, it could be an O-ring, without moving away from the scope of the invention.

The invention also aims for a pipetting system comprising a lower end such as defined above, said pipetting system being a manual sampling pipette, motorised, or hybrid, or this system being an automated pipetting system, called a robot.

Finally, the invention is based on an assembly comprising such a pipetting system, as well as at least one sampling cone mounted on the tip and retained on it by friction with the first and second retaining elements, or with the second and third retaining elements.

Other advantages and characteristics of the invention will appear in the non-limiting detailed description below.

BRIEF DESCRIPTION OF THE DRAWINGS

This description will be made regarding the appended drawings, among which.

DETAILED DESCRIPTION OF PREFERRED EMBODIMENTS

Figure 1:
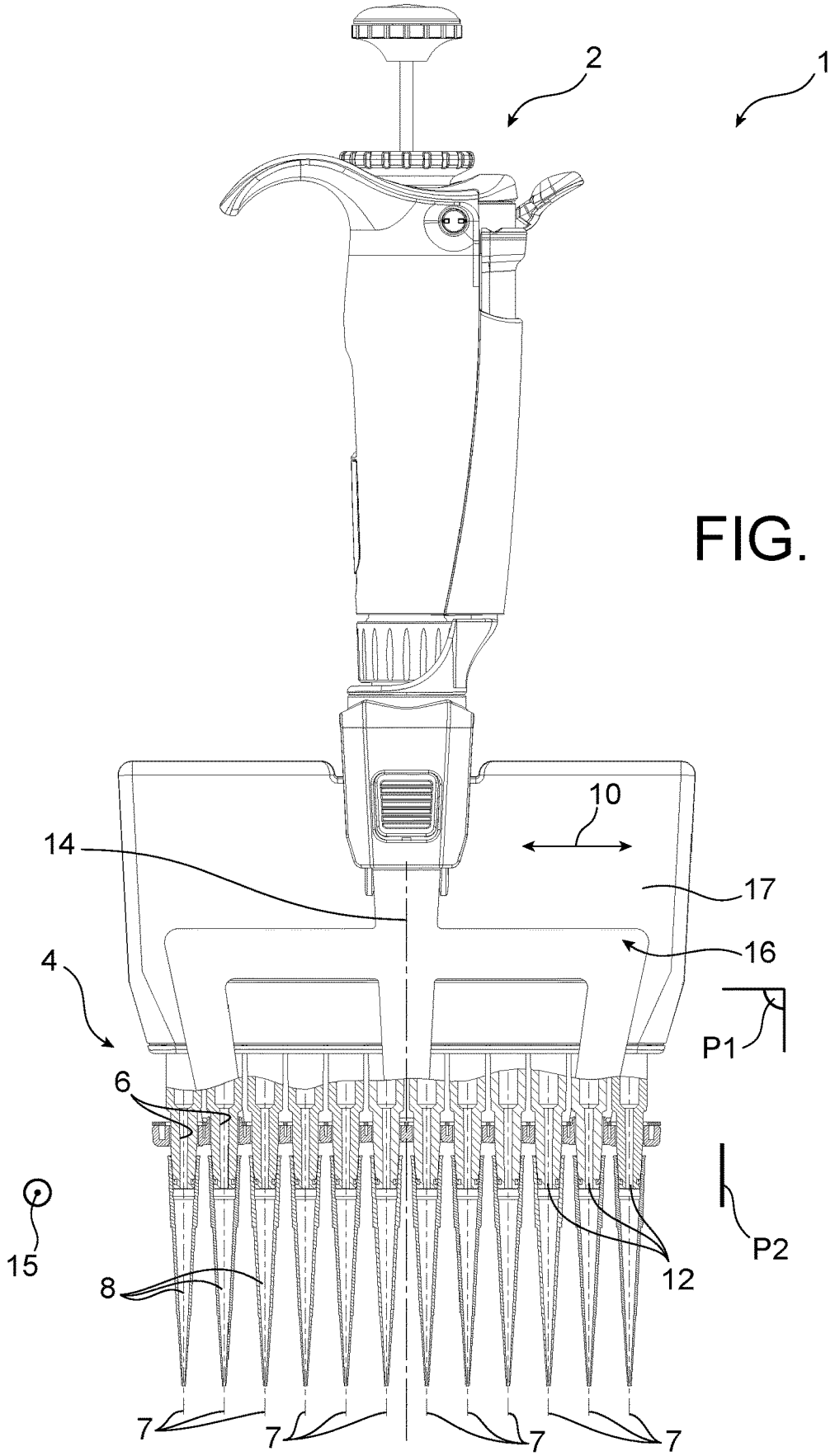
FIG. 1 represents a front view of an air displacement multichannel sampling pipette, according to the invention.
Figure 8:
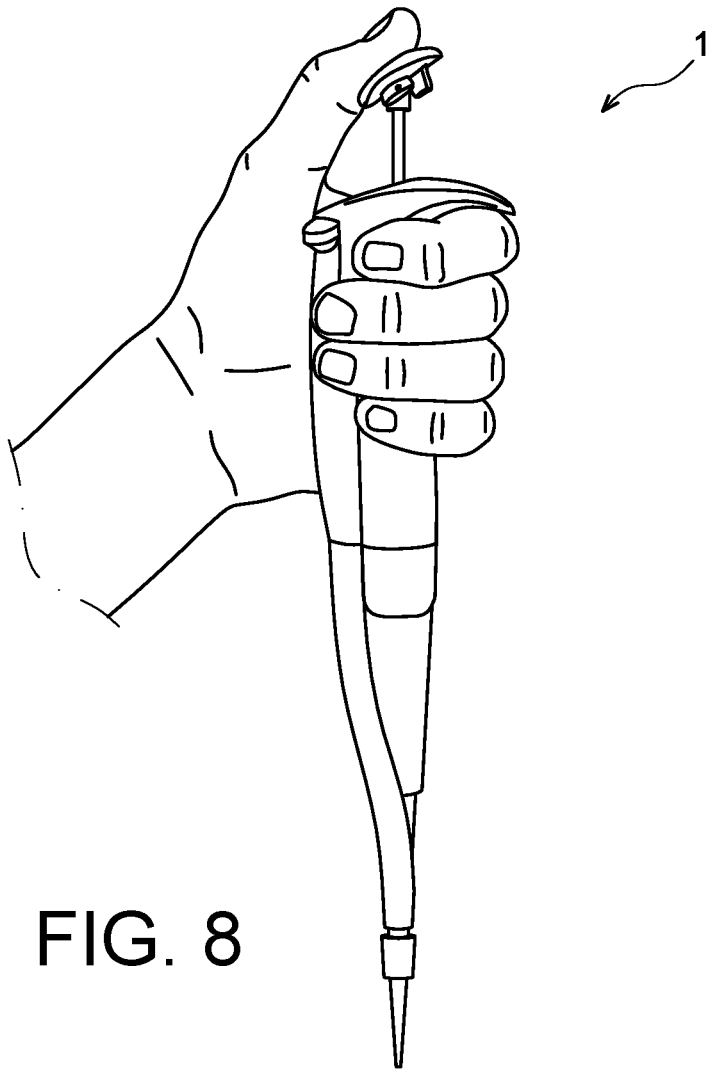
FIG. 8 represents a perspective view of a single-channel sampling pipette, according to the invention.

In reference firstly to FIG. 1, a multichannel sampling pipette 1 is represented, according to a preferred embodiment of the present invention. However, the invention is not limited to multichannel pipettes, but is applied similarly to pipettes called "single-channel", such as the pipette represented in FIG. 8.

The air displacement pipette 1, manual or motorised, comprises, in the upper part, a body forming a handle 2, as well as a lower end 4, also subject of the present invention, integrating at the lower end thereof, pipette sampling cone-carrying tips 6, on which the cones of consumables 8 are intended to be press-fitted. Each cone 8 and the associated tip thereof form an assembly, also specific to the present invention.

The sampling cone-carrying tips 6 are spaced from one another along a lateral direction of the pipetting system, or again pipette lateral direction, represented by the arrow 10. Each tip 6 has a longitudinal axis 7, also called central axis, orthogonal to the direction 10. All longitudinal axes 7 are parallel and fall into a first fictitious plane P1, parallel to the direction 10. Furthermore, a second fictitious plane P2 has been represented in FIG. 1, this second plane P2 being orthogonal to the first plane P1 and parallel to a longitudinal central axis of pipette 14.

Subsequently, it will be considered that at each tip 6, are associated a first fictitious plane P1 and a second fictitious plane P2, being intercepted at the level of the longitudinal axis 7 of the tip in question. In the plane P2, a direction 15 is also related, for moving the pipette by the operator during a movement called "licking", during which the pipette is gradually moved above the successive lines of shafts of a plate, to dispense here the liquid sampled beforehand in the pipette. In this regard, it is noted that the number of tips 6 is preferably between 8 and 12, and that the plate used equally has rows of shafts, as well as a number of lines adapted, for example, to reach 384 shafts.

Each tip 6 has a through bore 12 communicating at the upper end thereof with a suction chamber (cannot be seen in FIG. 1), and at the lower end thereof, with a sampling cone 8. The through bore 12 is centred on the associated tip 6 thereof, in other words, centred on the longitudinal axis 7 of the tip on which is centred the press-fitted cone 8.

As is known to a person skilled in the art, the lower end 4 is preferably mounted screwed on the body 2 forming a handle. In a known manner, the lower end 4 comprises a fixed body 16 covered by a removable outer cap 17, and, at the low end thereof, the tips 6. The mobile inner parts of this lower end 4 are conventional, and will not be defined further. They relate, in particular, to a plurality of pistons parallel to the axis 14 and each associated with a tip 6.

Figure 2:
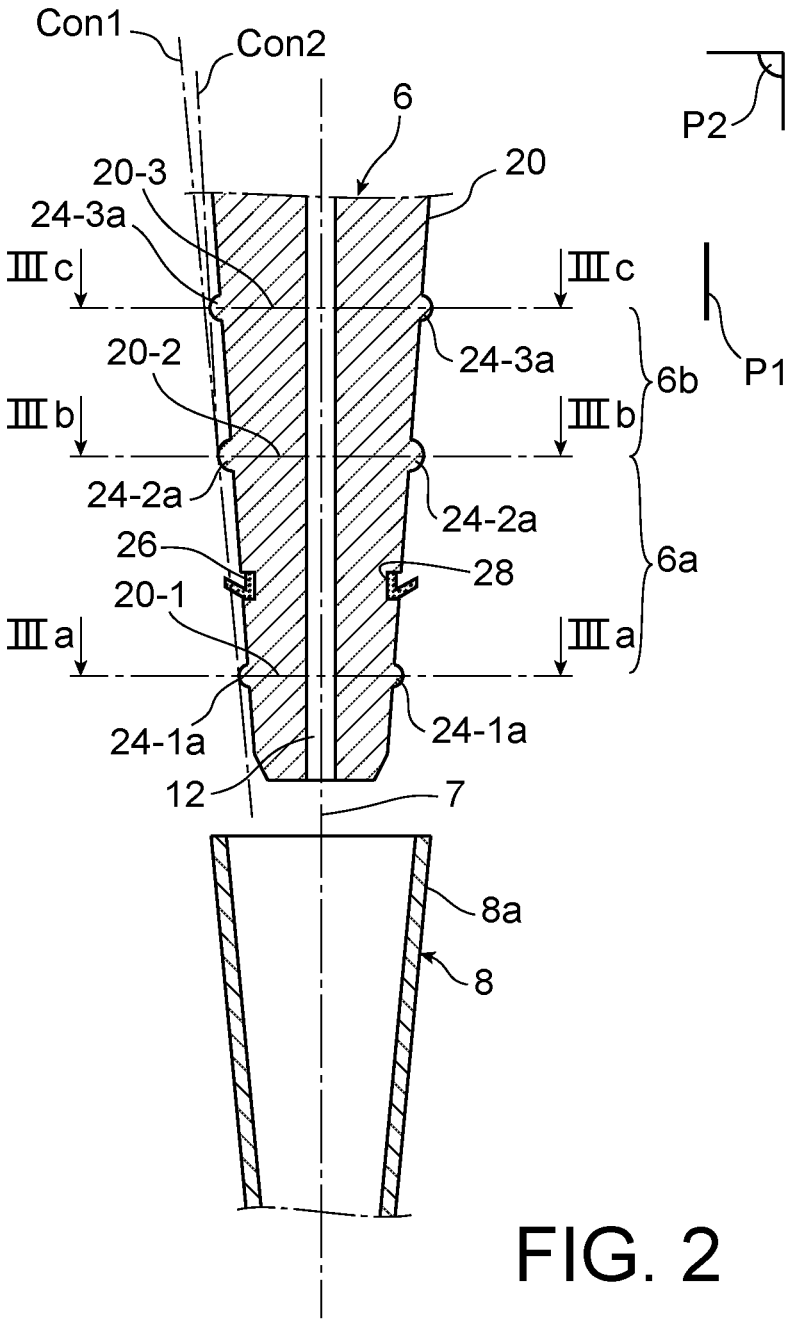
FIG. 2 represents a partial, enlarged, longitudinal cross-sectional view of one of the tips of the pipette shown in the preceding figure, before the press-fitting of a sampling cone.
Figure 3A:
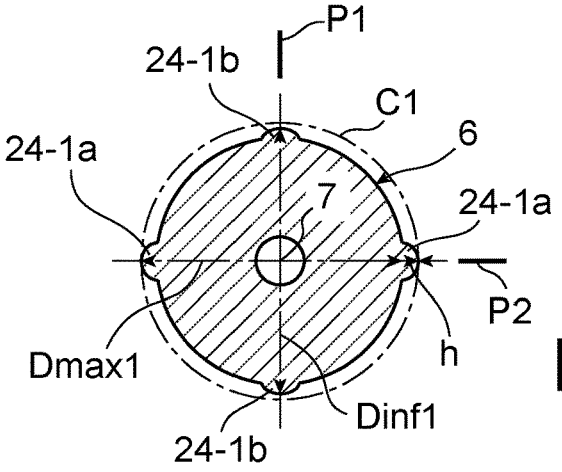
FIGS. 3*a* to 3*c* represent transversal cross-sectional views taken along the lines IIIa-IIIa to IIIc-IIIc in FIG. 2.
Figure 3B:
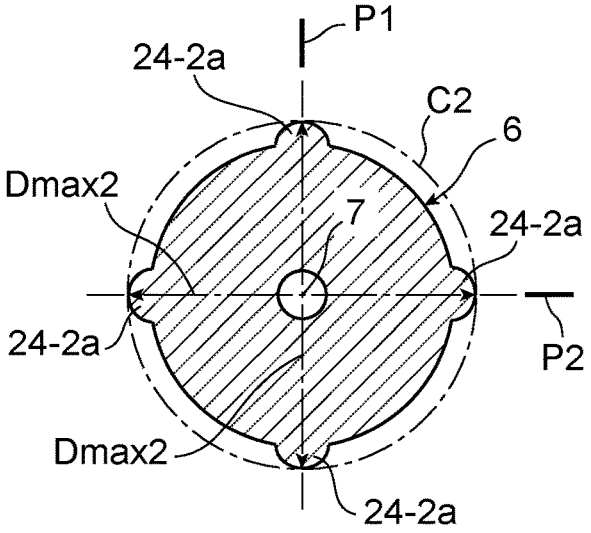
Figure 3C:
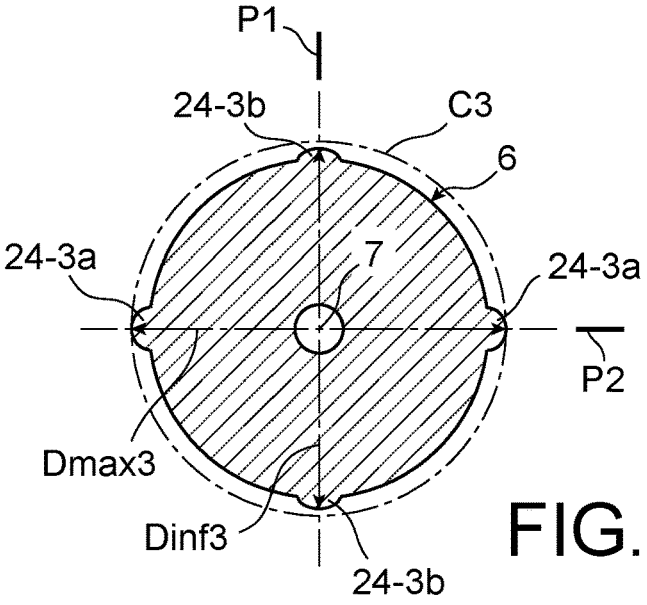

One of the particularities of the invention resides in the design of the lower end 4, and in particular, of the tips 6 thereof, one of which will now be detailed in FIGS. 2 to 3*c* representing a preferred embodiment. The other tips 6 of the pipette have an identical or similar design, being reminded that all the tips are parallel and fall into the first hypothetical plane P1.

The tip 6, at the low end thereof, has an outer surface 20 of overall cylindrical or truncated shape, getting narrower towards the bottom.

Generally, the tip is equipped with four zones for cooperating with the cones that it is likely to receive, these zones being spaced from one another along the longitudinal axis 7.

It firstly relates to three groups of elements for retaining the sampling cones by friction. The lowest group is the first group, comprising the first retaining elements, arranged protruding radially towards the outside from a first zone 20-1 of the surface 20, and spaced circumferentially from one another. Here, it relates to four first retaining elements, among which two first retaining elements 24-1*a* are arranged in the second fictitious plane P2, and defining a larger outer diameter, called first maximum outer diameter Dmax1. This diameter Dmax1 defines a first fictitious circle C1 centred on the axis 7 and inside which are contained two other first retaining elements 24-1*b*, radially remote from this same circle. The two elements 24-1*b* together form a couple which defines a first lower diameter Dinf1 of smaller size than that of the diameter Dmax1. This diameter Dinf1 is orthogonal to the diameter Dmax1, and situated in the first fictitious plane P1.

It is indicated that on the figures, the retaining elements have been voluntarily enlarged for reasons of clarity. In reality, there are simple reliefs having a low height h of around 0.2 to 0.7 mm, this height h corresponding to the protruding distance from the outer surface 20.

Then, a second group comprising second retaining elements arranged radially protruding towards the outside from a second zone 20-2 of the surface 20 is provided, and spaced circumferentially from one another. Here, it relates to four second retaining elements, among which two second retaining elements 24-2*a* are arranged in the second fictitious plane P2, and defining a larger outer diameter, called second maximum outer diameter Dmax2. This diameter Dmax2 defines a second fictitious circle C2 centred on the axis 7 and on which is also located, two other second retaining elements 24-2*a*. These two other elements together form a couple which defines another second maximum outer diameter Dmax2, situated in the first fictitious plane P1. Thus, the two maximum outer diameters Dmax2 are of the same size, and, more generally, all the second retaining elements 24-2*a* fall into the same second fictitious circle C2.

The highest group on the tip is the third group, comprising the third retaining elements, arranged radially protruding towards the outside, from a third zone 20-3 of the surface 20, and spaced circumferentially from one another. Here, it relates to four third retaining elements, among which two third retaining elements 24-3*a* are arranged in the second fictitious plane P2, and defining a larger outer diameter, called third maximum outer diameter Dmax3. This diameter Dmax3 defines a third fictitious circle C3 centred on the axis 7 and inside which are contained two other third retaining elements 24-3*b*, radially remote from this same circle. The two elements 24-3*b* together form a couple which defines a third lower diameter Dinf3 of smaller size than that of the diameter Dmax3. This diameter Dinf3 is orthogonal to the diameter Dmax3, and situated in the first fictitious plane P1.

Moreover, the fourth zone for cooperating with the cone is constituted by an annular gasket 26, housed in a recess 28 of the outer surface 20 of the tip. It preferably relates to a lip seal 26 to decrease the press-fitting force, this seal being situated between the first group and the second group. Alternatively, the seal 26 could be arranged between the second group and the third group, without moving away from scope of the invention.

The lip seal 26 has one or more lips, preferably one single lip. The lip is of a truncated shape, flaring towards the top, from an annular base of the seal. The annular base and the lip are preferably made from one single part, from EPDM-type elastomer material, while having a Shore A hardness of 40 to 100.

In a non-constrained state, the lip seal 26 has an outer diameter, for example, of around 4 mm.

The first maximum outer diameter Dmax1 is less than the second maximum outer diameter Dmax2. Together, they define, thanks to the difference in size thereof, a first longitudinal portion of tip 6*a* centred on the axis 7 and having a first conicity, schematised by the line referenced Con1 in FIG. 2. Similarly, the second maximum outer diameter Dmax2 is less than the third maximum outer diameter Dmax3. Together, they define, thanks to the difference in size, a second longitudinal portion of tip 6*b* adjacent to the first portion 6*a*, and also centred on the axis 7. The second portion 6*b* itself has a second conicity, schematised by the line reference Con2 in FIG. 2, this second conicity being less than the first one.

As an example, the first conicity Con1 is between 3 and 4.5°, whereas the second conicity Con2 is between 2 and 3.4°.

Thus, according to the conicity of the collar 8*a* of the cone to be press-fitted, the latter will have the inner surface thereof held by friction, either by the first and the second group of retaining elements, or by the second and third groups of retaining elements. In any case, the retention by friction will be achieved using two groups, axially spaced from one another, for a satisfactory mechanical holding, and for the preservation of the centring and of the parallelism between the cones present on the different tips of the multichannel pipette.

The sealing itself represents a function fulfilled separately, by the dedicated seal 26.

Figure 4:
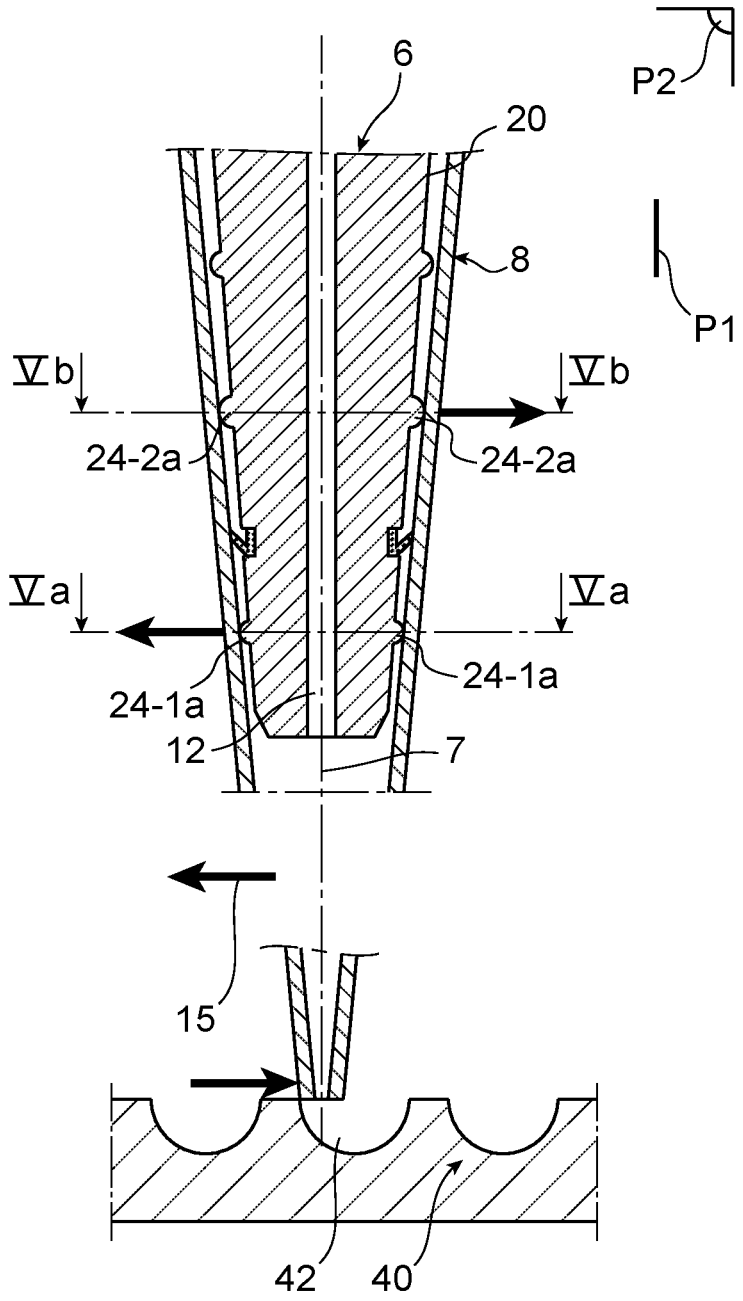
FIG. 4 is a view similar to that in FIG. 2, on which the cone-tip assembly has been represented in a functioning position and with a cone having a first conicity.
Figure 5A:
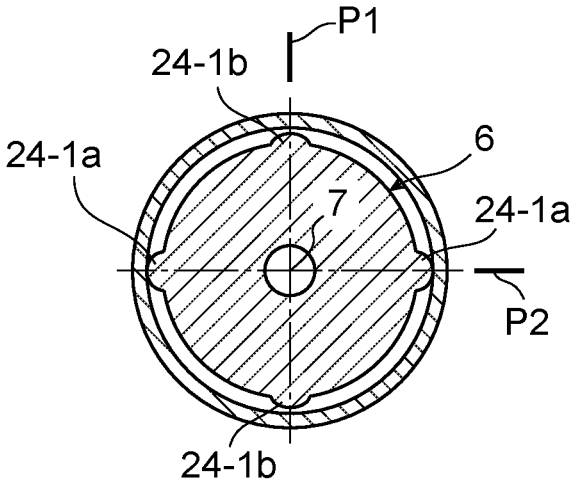
FIGS. 5*a* and 5*b* represent transversal cross-sectional views taken along the lines Va-Va and Vb-Vb in FIG. 4.
Figure 5B:
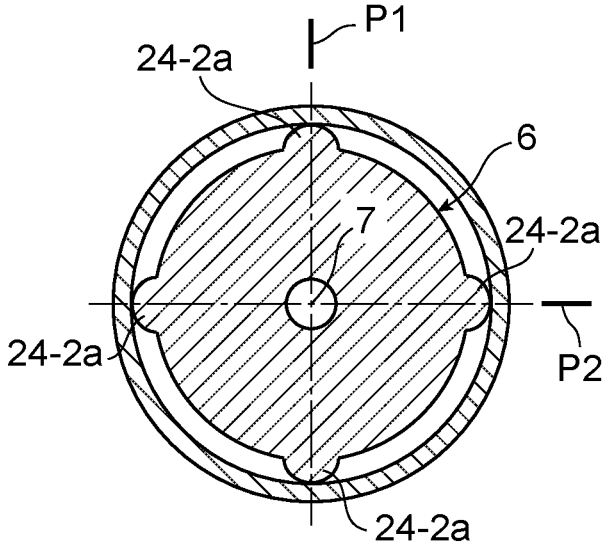
Figure 5A:
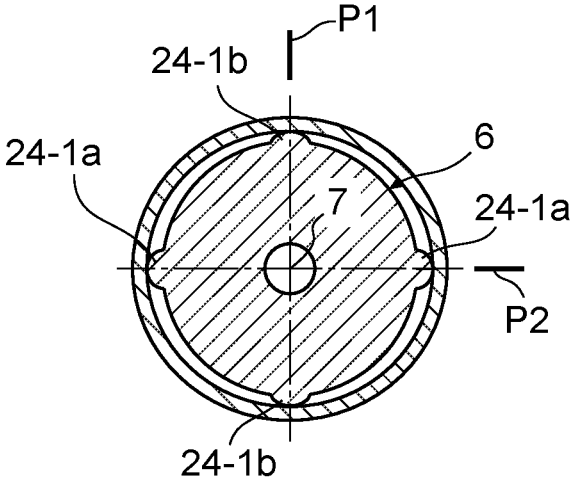

Now, in reference to FIGS. 4 to 5*a*', different examples of cooperation between the tip 6 and the cones 8 having conicities adapted to the first conicity Con1 defined by the first and second retaining elements are shown. In FIG. 4, the arrows carried on the cone show the forces to which it is subjected during a scraping of the end thereof on the shaft 42 of a plate 40, during a licking movement 15.

FIG. 4 thus shows the contact between, on the one hand, the first elements 24-1*a* and the inner truncated surface of the collar of the cone, and on the other hand, between the second elements 24-2*a* and this same inner surface. In this first example, the size of the cone is such that the retention thereof at the level of the first group is exclusively achieved by the two first elements 24-1*a*, since there is no contact with the two other first elements 24-1*b*. This example is shown in FIGS. 4 and 5*a*. In addition, because of the axisymmetric character thereof, the second group establishes a contact between each of the retaining elements 24-2*a* thereof and the inner surface of the collar, as is shown in FIG. 5*b*.

In another example shown in FIG. 5*a*', the larger cone 8 is deformed by the abutment of the first elements 24-1*a* during a deeper penetration of the tip 6 in the cone, this deformation having a substantially elliptic character leading to the contact of the other elements 24-1*b* with the inner surface of the cone.

Figure 6:
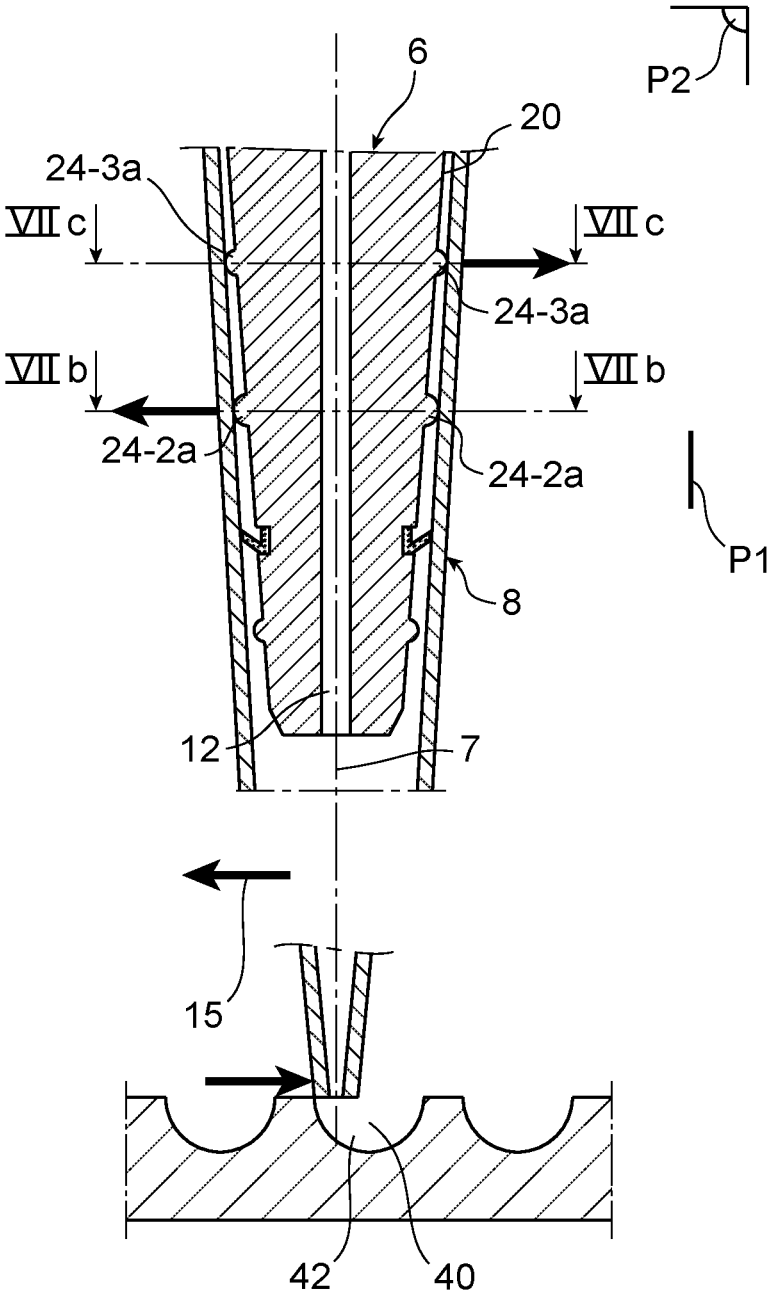
FIG. 6 is a view similar to that in FIG. 2, on which the cone-tip assembly has been represented in a functioning position and with a cone having a second conicity.
Figure 7C:
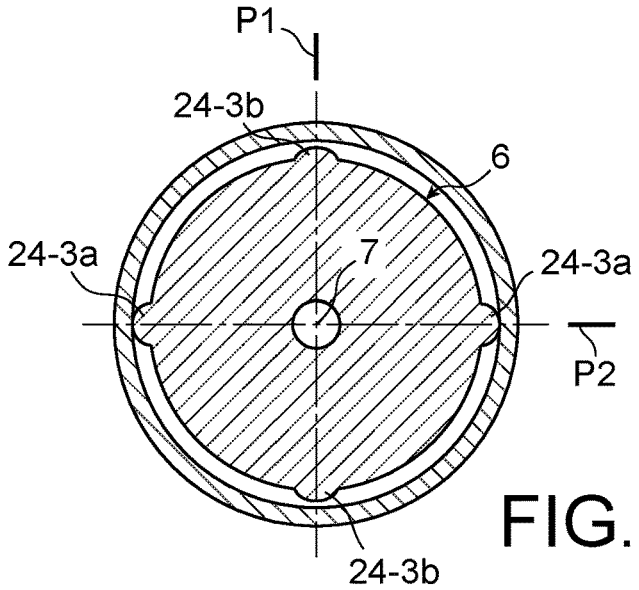
FIGS. 7*b* and 7*c* represent transversal cross-sectional views taken along the lines VIIb-VIIb and VIIc-VIIc in FIG. 6.
Figure 7B:
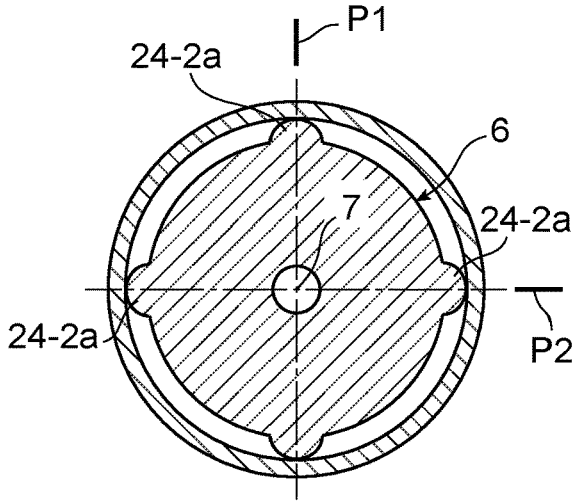
Figure 7C:
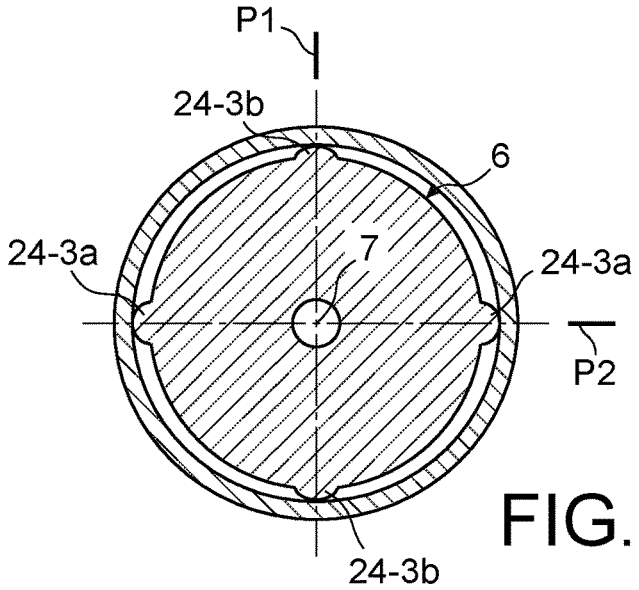

Now, in reference to FIGS. 6 to 7*c*, different examples of cooperation between the tip 6 and the cones 8 having conicities adapted to the second conicity Con2 defined by the second and third retaining elements are shown.

FIG. 6 shows the contact between, on the one hand, the second elements 24-2*a* and the inner truncated surface of the collar of the cone, and on the other hand, between the third elements 24-3*a* and this same inner surface. In this example, the size of the cone is such that the retention thereof at the level of the third group is exclusively achieved by the two third elements 24-3*a*, since there is no contact with the two other third elements 24-3*b*. This example is shown in FIGS. 6 and 7*c*. In addition, because of the axisymmetric character thereof, the second group here also establishes a contact between each of the retaining elements 24-2*a* thereof and the inner surface of the collar, as is shown in FIG. 7*b*.

In another example shown in FIG. 7*c*', the larger cone 8 is deformed by the abutment of the third elements 24-3*a* during a deeper penetration of the tip 6 in the cone, this deformation having a substantially elliptic character, leading to the contact of the other third elements 24-3*b* with the inner surface of the cone.

Of course, various modifications can be made by a person skilled in the art to the invention which has just been defined, only as non-limiting examples. In particular, the invention is identically or similarly applied to a tip of an automated pipetting system, also called a robot.

What is claimed is:

1. A sampling cone-carrying tip for a lower end of a pipetting system, the tip having a longitudinal axis falling into a first fictitious plane, comprising successively, from bottom to top, along the longitudinal axis thereof, radially protruding towards an outside from an outer surface of the tip:

a first group of first retaining elements for a sampling cone spaced from one another along a first annular zone of the tip, two of said first retaining elements being arranged in a second fictitious plane, orthogonal to the first fictitious plane, and defining a first maximum outer diameter of the tip in the first annular zone;

a second group of second retaining elements for a sampling cone spaced from one another along a second annular zone of the tip, two of said second retaining elements being arranged in said second fictitious plane and defining a second maximum outer diameter of the tip in the second annular zone;

a third group of third retaining elements for a sampling cone spaced from one another along a third annular zone of the tip, two of said third retaining elements being arranged in said second fictitious plane and defining a third maximum outer diameter of the tip in the third annular zone;

in that the tip also carries a gasket arranged between the first and the third annular zone of the tip, and wherein the first maximum outer diameter as well as the second maximum outer diameter are different so as to together define a first tip portion having a first conicity, and wherein the second maximum outer diameter, as well as the third maximum outer diameter are different so as to together define a second tip portion having a second conicity less than the first conicity.

2. A lower end of a pipetting system comprising at least one sampling cone-carrying tip according to claim 1.

3. A lower end according to claim 2, intended for a single-channel pipetting system and comprising one single sampling cone-carrying tip.

4. A lower end according to claim 2, intended for a multichannel pipetting system and comprising a plurality of sampling cone-carrying tips having longitudinal axes falling into said first fictitious plane.

5. A lower end according to claim 2, wherein the first conicity is between 3 and 4.5°, and in that the second conicity is between 2 and 3.4°.

6. A lower end according to claim 2, the wherein a number of tips is between 2 and 16.

7. A lower end according to claim 2, wherein the gasket is a lip seal.

8. A lower end according to claim 2, wherein the first retaining elements of the first group, except for said two first retaining elements defining the first maximum outer diameter, are situated radially towards the inside and remotely from a first fictitious circle defined by said first maximum outer diameter.

9. A lower end according to claim 8, wherein the first group comprises, in addition to said two first retaining elements defining the first maximum outer diameter, one or more couples of first retaining elements defining one or more first diameters less than the first maximum outer diameter, among which at least one of the first diameters is situated in said first fictitious plane.

10. A lower end according to claim 2, wherein the third retaining elements of the third group, except for said two third retaining elements defining the third maximum outer diameter, are situated radially towards the inside and remotely from a third fictitious circle defined by said third maximum outer diameter.

11. A lower end according to claim 10, wherein the third group comprises, in addition to said two third retaining elements defining the third maximum outer diameter, one or more couples of third retaining elements defining one or more third diameters less than the third maximum outer diameter, among which at least one of the third diameters is situated in said first fictitious plane.

12. A lower end according to claim 2, wherein the second retaining elements of the second group are situated on a second fictitious circle defined by said second maximum outer diameter.

13. A lower end according to claim 12, wherein the second group comprises, in addition to said two second retaining elements defining the second maximum outer diameter, one or more couples of second retaining elements defining one or more other second maximum outer diameters, among which at least one second maximum outer diameter is situated in said first fictitious plane.

14. Pipetting system comprising a lower end according to claim 2, said pipetting system being a sampling pipette or an automated pipetting system.

15. An assembly comprising a pipetting system according to claim 14, as well as at least one sampling cone mounted on the tip and retained on it by friction with the first and second retaining elements, or with the second and third retaining elements.

* * * * *